US012692449B2

(12) United States Patent
Schuetzle et al.

(10) Patent No.: US 12,692,449 B2
(45) Date of Patent: Jul. 28, 2026

(54) SYSTEMS AND METHODS FOR PRODUCING NEGATIVE CARBON INTENSITY HYDROCARBON PRODUCTS

(71) Applicant: Infinium Technology, LLC, Sacramento, CA (US)

(72) Inventors: Robert Schuetzle, Sacramento, CA (US); Dennis Schuetzle, Grass Valley, CA (US); Anja Rumplecker Galloway, San Rafael, CA (US); Thomas P. Griffin, Cave Creek, AZ (US); Orion Hanbury, Sacramento, CA (US); Matthew Caldwell, West Sacramento, CA (US); Solmon Dikran, Sacramento, CA (US)

(73) Assignee: Infinium Technology, LLC, Sacramento, CA (US)

( * ) Notice: Subject to any disclaimer, the term of this patent is extended or adjusted under 35 U.S.C. 154(b) by 158 days.

(21) Appl. No.: 18/445,447

(22) Filed: Aug. 18, 2023

(65) Prior Publication Data

US 2024/0093105 A1 Mar. 21, 2024

Related U.S. Application Data

(60) Provisional application No. 63/474,744, filed on Sep. 8, 2022.

(51) Int. Cl.
*C10G 2/00* (2006.01)
*C10L 1/04* (2006.01)

(52) U.S. Cl.
CPC . *C10L 1/04* (2013.01); *C10G 2/00* (2013.01)

(58) Field of Classification Search
CPC .... C10L 1/04; C10L 1/08; C10G 2/00; C10G 2/32
See application file for complete search history.

(56) References Cited

U.S. PATENT DOCUMENTS

| | | | | |
|---|---|---|---|---|
| 2019/0194559 | A1 | 6/2019 | Mdleleni et al. | |
| 2021/0285017 | A1 | 9/2021 | Feldman et al. | |
| 2021/0340075 | A1* | 11/2021 | Schuetzle | B01J 37/0225 |
| 2023/0030413 | A1 | 2/2023 | Iversen et al. | |
| 2023/0295517 | A1* | 9/2023 | Claxton | C25B 1/04 |

OTHER PUBLICATIONS

Argonne National Laboratory: Greet Model, ANL, Argonne, IL (2021) www.greet.es.anl.gov.

(Continued)

*Primary Examiner* — In Suk C Bullock
*Assistant Examiner* — Jason Y Chong
(74) *Attorney, Agent, or Firm* — McKinney Law Group APC; Jeffrey A. McKinney

(57) ABSTRACT

Provided herein are systems and methods for controlling the production of negative carbon-intensity liquid hydrocarbons (e.g., for fuels and chemicals). In various aspects, the methods utilize a feedstock having a negative carbon intensity, produce a co-product from the feedstock, sequester a portion of the $CO_2$ derived from the feedstock, or utilize a portion of the $O_2$ in a process that consumes $O_2$ and emits $CO_2$.

9 Claims, 6 Drawing Sheets

(56) References Cited

OTHER PUBLICATIONS

Budina, S. "Going carbon negative: what are the technology options?" International Energy Agency (Jan. 2020) www.iea.org/commentaries/going-carbon-negative-what-are-the-technology-options.

California Air Resources Board, "LCFS pathway certified carbon intensities" (2022) ww2.arb.ca.gov/resources/documents/lcfs-pathway-certified-carbon-intensities.

IPCC, 2023: Summary for Policymakers. In: Climate Change 2023: Synthesis Report. Contribution of Working Groups I, II and III to the Sixth Assessment Report of the Intergovernmental Panel on Climate Change [Core Writing Team, H. Lee and J. Romero (eds.)]. IPCC, Geneva, Switzerland, pp. 1-34, doi: 10.59327/IPCC/AR6-9789291691647.001.

National Academies of Sciences, Engineering, and Medicine: Gaseous carbon waste streams utilization: status and research needs, Chapter 4: Chemical utilization of CO2 into chemicals and fuels, The National Academies Press, pp. 63-97 (2019). https://doi.org/10.17226/25232.

Ransom, C. et al. State of the global climate 2021, World Meteorological Organization (2021) www.public.wmo.int/en/our-mandate/climate/wmo-statement-state-of-global-climate.

Schuetzle, D. Historical and predicted global climate changes and some potential accelerated climate modernization approaches, Global Climate Action Summit, San Francisco, CA (Sep. 10-14, 2018) and the Under2Coalition, ResearchGate, 1-42 (2020) www.researchgate.net.

U.S. Energy Information Administration (EIA): U.S. energy related CO2 emissions (Dec. 22, 2021) www.eia.gov./environment/emissions/carbon.

* cited by examiner

SYSTEMS AND METHODS FOR PRODUCING NEGATIVE CARBON INTENSITY HYDROCARBON PRODUCTS

CROSS-REFERENCE TO RELATED APPLICATION

This application claims the benefit of U.S. Provisional Patent Application No. 63/474,744, filed Sep. 8, 2022, which is incorporated by reference herein in its entirety.

FIELD OF THE INVENTION

The present invention is generally directed to the production of hydrocarbon products. It is more specifically directed to the production of hydrocarbon products that have a negative carbon intensity.

BACKGROUND OF THE INVENTION

Carbon dioxide ($CO_2$) is produced by many industrial and biological processes. However, since $CO_2$ has been identified as a significant greenhouse gas, $CO_2$ emissions need to be significantly reduced from these processes.

The International Panel on Climate Change (IPCC) published reports during 2022 which describes progress on the goal of keeping global warming to below 2.0° C. (3.6° F.) with the main goal of limiting it to 1.5° C. (2.7. ° F.) (IPCC, 2022) compared to pre-industrial periods. However, several published studies have shown that the 1.5° C. increase may be reached by 2025-2027 at which time the planet will probably have reached a "tipping point" (Schuetzle, 2020; WMO, 2021). This tipping point occurs when small increases in temperature will cause significant increased changes in the global climate. Reducing $CO_2$ emissions may not be sufficient to achieve the goal to curb the effects of global warming. It will be necessary to remove more $CO_2$ from various processes that are emitted on a total life-cycle basis.

As a result, global efforts are being expanded to mitigate climate change. Several key strategies are being implemented to reduce greenhouse gas emissions.

Carbon pricing is a tool to effectively incentivize the production and use of low carbon fuels, materials, and chemicals. Emissions trading can also be used as a policy tool to ensure that companies are collectively staying within a certain limit of greenhouse gas (GHG) emissions—typically referred to as an emissions cap. Carbon markets can be voluntary or mandatory, and different carbon pricing instruments achieve the costs in different ways. A carbon credit corresponds to one metric ton of reduced, avoided or removed $CO_2$ or equivalent GHG.

Carbon Intensity (CI) is used to measure all greenhouse gas emissions associated with the production, distribution, and consumption of a fuel. CI scores are developed based on life cycle analysis methodology, with varying scores due to feedstock types, origin, raw material processing efficiencies and use within transportation. Net-zero means total emissions are equal to or less than the emissions removed from the environment. Carbon neutrality, or "net zero," means that any $CO_2$ released into the atmosphere from human activity is balanced by an equivalent amount being removed. Carbon negative processes require that more $CO_2$ is removed from the atmosphere than they emit on a total life-cycle basis (Budina, 2022). Carbon-negative processes effectively reduce the $CO_2$ in the atmosphere, while producing valuable products.

Carbon intensity (CI) is determined by measuring the amount of life-cycle greenhouse gas emissions (GHG) emitted, per unit of energy of delivered to a hydrocarbon production process. CI is expressed in grams of $CO_2$ equivalent per megajoule (g $CO_{2e}$/MJ) (U.S. EIA, 2021). The CI values presented in this document are measurements of the GHG emissions associated with the various production, distribution, and consumption steps in the well to wheels life cycle assessment (WTW-LCA) for the production of low-carbon transportation fuel and commodity chemicals.

A negative CI is achieved when a particular process removes more $CO_2$ from various processes than are emitted on a total life-cycle basis. Negative CI emissions are needed to: 1) offset residual, hard-to-abate emissions in industries such as cement; 2) lessen atmospheric $CO_2$ if emission reductions aren't delivered quickly enough; and 3) remove historical emissions from the atmosphere on a path to a stable long-term climate. Negative CI solutions that have been proposed for $CO_2$ are categorized as biological; capture and storage; and technological. Some examples of these potential negative CI solutions include:

Biological

1. Large-scale planting of trees, and sustainable land management which stores carbon in soil and biomass.
2. Adapted land management to increase and permanently bind carbon from atmospheric $CO_2$ in the soil, for example by ploughing-under crop residues or reduced tillage.
3. Pyrolysis of biomass to form charcoal (biochar) that keeps carbon in the soil—or to be exact, in the charcoal—for many years.
4. Restoration of reefs and seagrass in shallow ocean areas to efficiently store $CO_2$.

Capture and Storage

1. Removal of $CO_2$ from industrial process emissions and storing it.
2. Removal of $CO_2$ from the atmosphere and storing it.

Technological

1. Conversion of captured $CO_2$ from industrial processes and ambient air to fuels and valuable products.

For many years, scientists and engineers have been aware of the potential economic and environmental benefits of using $CO_2$ as a feedstock for the synthesis of commodity chemicals and fuels. Nevertheless, despite the large amount of fundamental research that has been performed regarding the conversion of $CO_2$ into more valuable products there are relatively few examples of industrially viable processes. The challenges associated with the conversion of $CO_2$ are primarily related to both its kinetic and thermodynamic stability. $CO_2$ cannot be converted into commodity chemicals or fuels without significant inputs of energy since this molecule contains strong bonds that are not particularly reactive. Consequentially, many of the available transformations of $CO_2$ require stoichiometric amounts of energy-intensive reagents. This can often generate significant amounts of waste and can result in in increased greenhouse gas footprints. The grand challenge for converting $CO_2$ waste streams into useful products is to develop processes that require minimal amounts of nonrenewable energy, are economically competitive, and provide substantial reductions in greenhouse gas emissions compared to existing technology (National Academies of Sciences, Engineering, and Medicine, 2019).

Although many process that have been reported in the current art for the conversion of $CO_2$ to liquid fuels and chemicals, these processes still have a positive CI value. Bio-methane is a potential, gas-phase transportation fuel and it is the only transportation fuel that has been produced to date with a negative CI value (California Air Resources Board, 2022). There is a need in the art for novel processes for the conversion of $CO_2$ to liquid fuels and chemicals.

SUMMARY OF THE INVENTION

The present disclosure describes systems and methods for producing carbon-negative hydrocarbon liquid fuels and chemicals from $CO_2$. These fuels are produced in a carbon negative e-fuel process that converts $CO_2$, low carbon electricity, and other optional feedstocks to a variety of products including e-fuels that effectively remove $CO_2$ from the atmosphere versus the base case. The carbon intensity or Well-to-Wheels Greenhouse Gas Content (WTW-GGC) of the e-fuels can be calculated using any suitable method. In cases where the hydrocarbon is a transportation fuel, the GREET model can be used (Argonne National Laboratory, 2021)

The need for carbon negative technologies to reduce atmospheric $CO_2$ levels has resulted in the Carbon Negative e-Hydrocarbon Refinery (CNER) process of this invention as shown in FIG. 4. $CO_2$ from air or a point source and renewable or low-carbon electricity as well as additional optional feedstocks are processed in the CNER. The additional feedstocks are also common including renewable natural gas (RNG) and industrial waste gases such as waste gases from steel mills, coke oven gases, and other carbon containing gases. Carbon negative hydrocarbons are produced in the CNER as well as optional non-combustible products. The hydrocarbons may be transportation fuels or chemical products (e-fuels).

The e-fuel is a renewable fuel of non-biological origin (RFNBO). The fuel produced from the negative carbon process may also be a Recycled Carbon Fuel (RCF) or other categories of fuel that achieve the negative carbon intensity. Non-combustible products are products that are used for non-fuel applications such as the production of plastics or other industrial goods where the carbon in the product is effectively stored in the product and has no significant probability to end up back in the atmosphere through a combustion process. Additional displacement products are optionally produced by the CNER. Displacement products are products that displace the use of products in the marketplace that are produced from fossil energy or fossil fuels. The CNER uses the renewable or low carbon electricity to electrolyze water to $H_2$ and $O_2$.

The methods employed are based upon the use of renewable or low carbon electrical power to electrolyze water into hydrogen ($H_2$) and oxygen ($O_2$). In one embodiment, the $H_2$ is reacted with $CO_2$ in a reverse water-gas shift reaction (RWGS), or $CO_2$ hydrogenation reaction, to produce synthesis gas, which can be in turn reacted to form hydrocarbons. In one embodiment, the $H_2$ is reacted directly with the $CO_2$ to produce hydrocarbons. In various aspects, the systems and methods provided herein achieve an overall negative carbon intensity by (a) utilizing a feedstock having a negative carbon intensity (e.g., feedstocks such as renewable natural gas), (b) producing a co-product from the feedstock that is not combusted and/or does not release $CO_2$ into the atmosphere, (c) sequestering a portion of the $CO_2$ derived from the feedstock, or (d) enabling the offsetting use of or displacing of other products such as $O_2$ in another industrial process. Intelligent process design and strategic optimization of feedstocks, co-products and products are the basis of overall carbon-negative processes.

Because the e-fuel produced by the CNER is synthesized from base molecules, the e-fuel produced has improved properties versus the fossil fuels that it replaces. For example, the diesel fuel produced in the CNER will have less than 0.1 ppm sulfur, cetane number of greater than 65, cetane index of greater than 65, and aromaticity of less 1 vol % as well as a negative WWGCC or carbon intensity.

DETAILED DESCRIPTION OF THE INVENTION

Transportation accounts for greater than 25% of the global $CO_2$ emissions. E-fuels are seen as one way to help decarbonize aviation and shipping and trucking. The key advantage of e-fuels is that they are drop-in fuels and can therefore be used in existing processes and engines. The key advantage of a negative CI fuel is in addition, the production and use of the fuel has a CI that is below zero and effectively removes $CO_2$ from the atmosphere. While electric battery technology to wean road vehicles off fossil fuels is meeting growing consumer demand, hard-to-electrify long-distance sectors like shipping, trucking and aviation sectors can be decarbonized with e-fuels. Heavy transport and aviation are some of the most carbon intensive transportation sectors. With a carbon negative e-fuel, it in fact may be more advantageous from an atmospheric $CO_2$ perspective to transition that hard to decarbonize applications to carbon negative e-fuel instead of to electric batter technology that at best will keep atmospheric $CO_2$ levels no better than today's levels.

Figure 1:
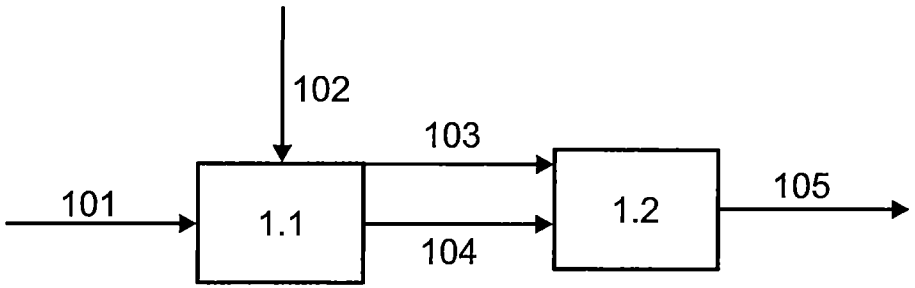
FIG. 1 shows a fossil fuel petroleum refinery example. The listed elements are: 1.1—Petroleum Refinery; 1.2—Fuel User; 101—Fossil Resource (Natural Gas and Petroleum; 102—Electricity from grid—fossil fuel and renewables; 103—Fossil Fuel (e.g., gasoline, diesel); 104—Other Refinery Products; 105—CO2 to atmosphere.

For comparison, FIG. 1 shows an overall process to produce fossil-based fuels. Stream 101 is fossil-based resource like petroleum and natural gas that is an input. Additionally, electricity from the grid which includes fossil and renewable electricity sources is used as input. Unit 1.1 is a petroleum refinery that produces petroleum-based fuels (like diesel and gasoline, stream 103 and other refinery products, stream 104). The petroleum-based fuels are then used by a fuel user denoted as unit 1.2 that converts the fuel to $CO_2$. This process results in an overall increase in the $CO_2$ in the atmosphere over time as carbon is removed from the ground and ends up in the atmosphere after the fuel is combusted. This is a carbon positive which results in a Carbon Intensity calculation of well over zero.

Figure 2:
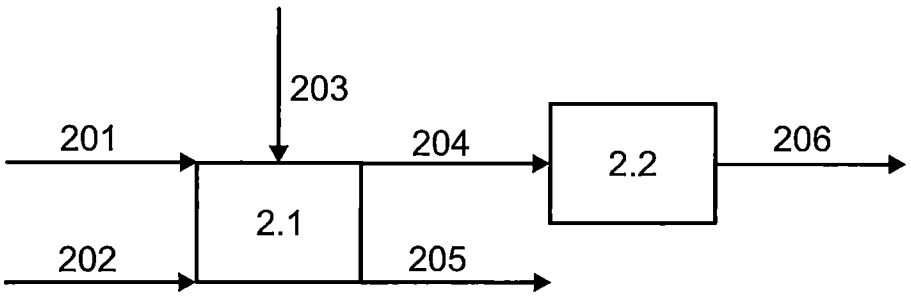
FIG. 2 shows a biorefinery that converts renewable biomass to biofuel. The listed elements are: 2.1—Biorefinery (renewable diesel plant or ethanol plant); 2.2—Fuel User; 201-CO2 from atmosphere (to produce renewable biomass); 202—Natural gas; 203—Electricity from grid (fossil and renewable); 204—Biofuel (ethanol or renewable diesel); 205—CO2 to atmosphere; 206—CO2 to atmosphere.

The first- and second-generation solutions to this problem was the use of a biorefinery as shown in FIG. 2. Stream 201 is $CO_2$ that is removed from the atmosphere to produce renewable biomass or other renewable feedstocks. Natural gas, stream 202, and electricity from the grid, stream 203, with stream 201 are processed in a biorefinery, unit 2.1. The biorefinery can be an ethanol production facility that uses corn or other grain sugars that are fermented to ethanol and separated to a final product. The biorefinery can also be a renewable diesel facility that uses fats, oils, and greases to produce renewable diesel by hydroprocessing the fats, oils, and greases to a product that meets diesel fuel specifications. The biofuel, stream 204, can be a renewable diesel fuel or ethanol. The biofuel is used by a fuel user, unit 2.2, that produces $CO_2$ from the fuel and the $CO_2$ is emitted to the atmosphere. Additionally, the biorefinery may emit $CO_2$ from the fermentation of the sugars or from the production of hydrogen from natural gas. For a biorefinery, the carbon intensity of the biofuel, stream 204, is typically 50-80% lower than the fuel produced by a petroleum refinery but the carbon intensity is still positive and global $CO_2$ emissions will continue to increase.

Figure 3:
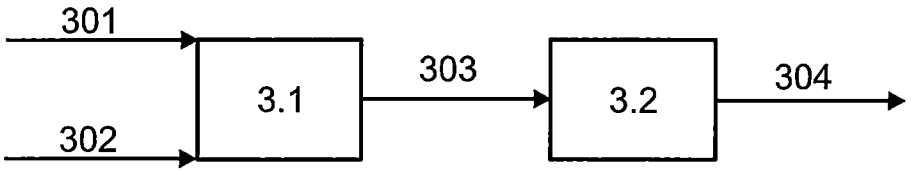
FIG. 3 shows a carbon neutral e-fuel facility. The listed elements are: 3.1—Carbon Neutral E-fuel facility; 3.2—Fuel user; 301—CO2 from air or point source; 302—Renewable or low carbon electricity; 303—Carbon Neutral E-fuel; 304—CO2 to atmosphere.

The need for even better, lower carbon intensity fuels has led to the development of a carbon neutral e-fuel process. FIG. 3 shows a typical configuration of this process. $CO_2$ from air or from a point $CO_2$ source is used with renewable or low carbon electricity in a carbon neutral e-fuel facility, unit 3.1, to produce a carbon neutral e-fuel, stream 303. The e-fuel is used by a fuel user, unit 3.2, to produce $CO_2$. Overall, this process results in a carbon neutral e-fuel, stream 303. The carbon intensity of the fuel is at or very close to 0. The amount of $CO_2$ that results from the combustion by the fuel user is the same as the amount of $CO_2$ that is taken from the air or the point source. While this is a substantial improvement versus the FIG. 1 and FIG. 2 processes, at best this process will keep atmospheric $CO_2$ levels to be no better than current levels.

Figure 4:
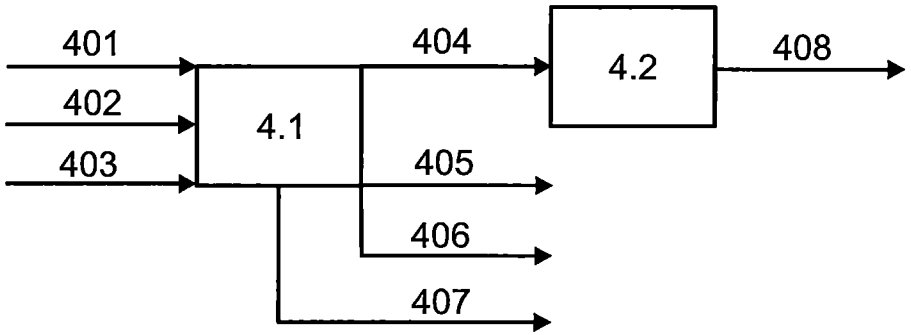
FIG. 4 shows a block flow diagram for a carbon negative e-fuels refinery. The listed elements are: 4.1—Carbon Negative E-Fuel refinery; 4.2—Fuel user; 401—CO2 from air or point source; 402—Renewable or low carbon electricity; 403—Other Feedstocks; 404—Carbon Negative E-fuel; 405—Non-combustiable products; 406—Other products; 407—CO2 to sequestration; 408—CO2 to atmosphere.

The need for carbon negative technologies to reduce atmospheric $CO_2$ levels has resulted in the CNER process of this invention as shown in FIG. 4. $CO_2$ from air or a point $CO_2$ source, stream 401, and renewable or low carbon electricity, stream 402, as well as additional optional feedstocks, stream 403, are processed in the CNER, unit 4.1. The electrolysis of water to $H_2$ and $O_2$ is a key process block in the CNER. The reaction of the $CO_2$, stream 401, with the produced $H_2$ is another key process block in the CNER. The additional feedstocks, stream 403, can be various streams including renewable natural gas (RNG), industrial waste gases such as waste gases from steel mills, coke oven gases, and other carbon containing gases.

In one embodiment, the RNG is as a fuel gas to fired heaters to increase the temperature of various streams inside the CNER including to heat the $H_2$ and $CO_2$ to reaction temperature.

In one embodiment, the industrial waste gases, stream 403, can be converted to syngas by reactions with the $O_2$ produced by the electrolysis process block.

In one embodiment, the electricity used in the CNER is from a bioenergy carbon capture and sequestration (BECCS) facility and may have a negative carbon intensity.

In one embodiment, the low carbon electricity is produced from a wind, solar or hydropower facility near the CNER or from wind, solar or hydropower facility that is remote from the CNER but whereby the power is delivered over the grid. Alternatively nuclear power, including existing nuclear technology and future generations of small modular reactors (SMRs) that are under development, may be used to deliver low carbon power to the CNER.

Carbon negative e-fuel is produced and shown as stream 404. Stream 405 is a stream comprising one or more non-combustible products. Non-combustible products produced in a CNER can be any material where effectively carbon that was derived from the $CO_2$ in the CNER feed is converted in the CNER to a product where the product is effectively sequestered in a product. Such non-combustible products include naphtha which includes $C_5$-$C_{12}$ materials, meaning hydrocarbons with 5 through 12 carbon atoms per molecule, that can be used to produce plastic or polymer products. Likewise, $C_2$-$C_4$ olefins, meaning hydrocarbon alkenes with 2 through 4 carbon atoms per molecule, can be used in the production of polymers and plastics. Ethane and propane products can be used in an ethylene cracker to produce olefins that are used in the production of polymer products.

Stream 406 includes other products that can be produced by the CNER. These products can be broadly classified as displacement products. These products are used in other applications but displace products that are produced using fossil fuels. Examples of displacement products include $O_2$ and $H_2$.

FIG. 4 stream 407 represents $CO_2$ that optionally is sent to geological sequestration. This also reduces the WTW-GGC of the CNER e-fuel. This $CO_2$ is captured from the combustion of fuel gas like the RNG or waste gases that are optional feedstock (stream 403).

In one embodiment, a portion of the $CO_2$ in stream 407 is a portion of the $CO_2$ feed to the CNER.

In one embodiment, the $CO_2$ in stream 407 is $CO_2$ that is produced within the CNER.

FIG. 4 also shows the that produced e-fuel is sent to a fuel user, unit 4.2, that ultimately combusts the fuel to produce $CO_2$ shown as stream 408.

The Life Cycle Assessment (LCA) or well-to-wheels greenhouse gas content (WTW-GGC) of the e-fuel produced in the CNER is negative. The carbon intensity can be calculated using any suitable method. In cases where the hydrocarbon is a transportation fuel, the GREET model can be used. The term "well-to-wheels greenhouse gas content—WTW-GGC" refers to a calculation that is done using a life-cycle greenhouse gas model, such as Argonne National Laboratories GREET ("Greenhouse gases, Regulated Emissions, and Energy Use in Transportation") model or another similar greenhouse gas model, that allows for the calculation of the amount of greenhouse gases that are produced throughout the entire lifecycle of the product (from "well to wheels"). The model considers, among other things the production method, the feedstock used in the production, the type of fuel produced, transportation of the fuel to market, and the emissions produced from combustion of the fuel when it is used.

Some versions of GREET include more than 100 fuel pathways including petroleum fuels, natural gas fuels, biofuels, hydrogen, and electricity produced from various energy feedstock sources. The GREET software for calculating WTW-GGC are readily available and can be downloaded by the public. The GREET model can be used to calculate the energy use and greenhouse gas (GHG) emissions associated with the production and use of a particular type of fuel. Other models for calculating WTW-GGC are available. For example, CA-GREET is a modified version of GREET used by the California Air Resources Board (CARB).

The WTW-GGC calculations include two parts. First, a well-to-tank (WTT) life cycle analysis of a petroleum-based fuel pathway includes all steps from crude oil recovery to final finished fuel. Second, a tank-to-wheel (TTW) analysis includes actual combustion of fuel in a motor vehicle for motive power. The WTT and TTW analyses are combined to provide a total well-to-wheel (WTW) analysis, which provides a calculation for a well-to-wheel greenhouse gas content ("WTW-GGC").

Thus, using the GREET or other models for calculating WTW-GGC, a WTW-GGC score of a particular fuel from a specific pathway can be compared with a petroleum derived fuel such as gasoline or diesel (which scores close to 100 $gCO_2e/MJ$). The lower the WTW-GGC, the lower the amount of greenhouse gas a particular fuel produces during its lifecycle. The current version of GREET used in the examples of this application is GREET version 13868. However other Lifecycle Analysis can be used and show similar results. In fact, ISO has issued two standards for Lifecycle Assessments, ISO 14040 and 14044.

Chemicals that can be produced in the CNER include non-combustible products, stream 405, such as ammonia, methanol, as well as high value-added chemicals such as formaldehyde, acetic acid, acetic aldehyde, or lower olefins and aromatic compounds (e.g., as starting materials and/or intermediates for either commodity or fine chemical production). This category of e-fuel production processes can be referred to as "Power to X", referring to renewable power being a primary input in producing X, where X is fuels, chemicals, natural gas, and the like. In an CNER, the production of these non-combustible chemicals reduces the WTW-GGC of the produced e-fuel.

In one aspect, provided herein is a method for producing a carbon-negative hydrocarbon. The method can comprise obtaining a feedstock comprising $CO_2$; electrolyzing water using renewable power to produce $H_2$ and $O_2$; reacting the $H_2$ with the $CO_2$ derived from the feedstock to produce synthesis gas; and synthesizing a hydrocarbon from the synthesis gas. The method can further include performing at least one of: utilizing a feedstock having a negative carbon intensity, producing a non-combusted co-product from the feedstock, sequestering a portion of the $CO_2$ derived from the feedstock, or utilizing a portion of the $O_2$ in a product or process such that the method is carbon negative.

The greenhouse gas emissions can be attributed to the hydrocarbon, $O_2$, and the co-products have a negative carbon footprint. An amount of greenhouse gas emissions attributed to the hydrocarbon, $O_2$, and the co-products can be less than an amount of greenhouse gas emissions attributed to the feedstock. In some cases, the negative carbon footprint is on a kg $CO_2$ basis.

Figure 5:
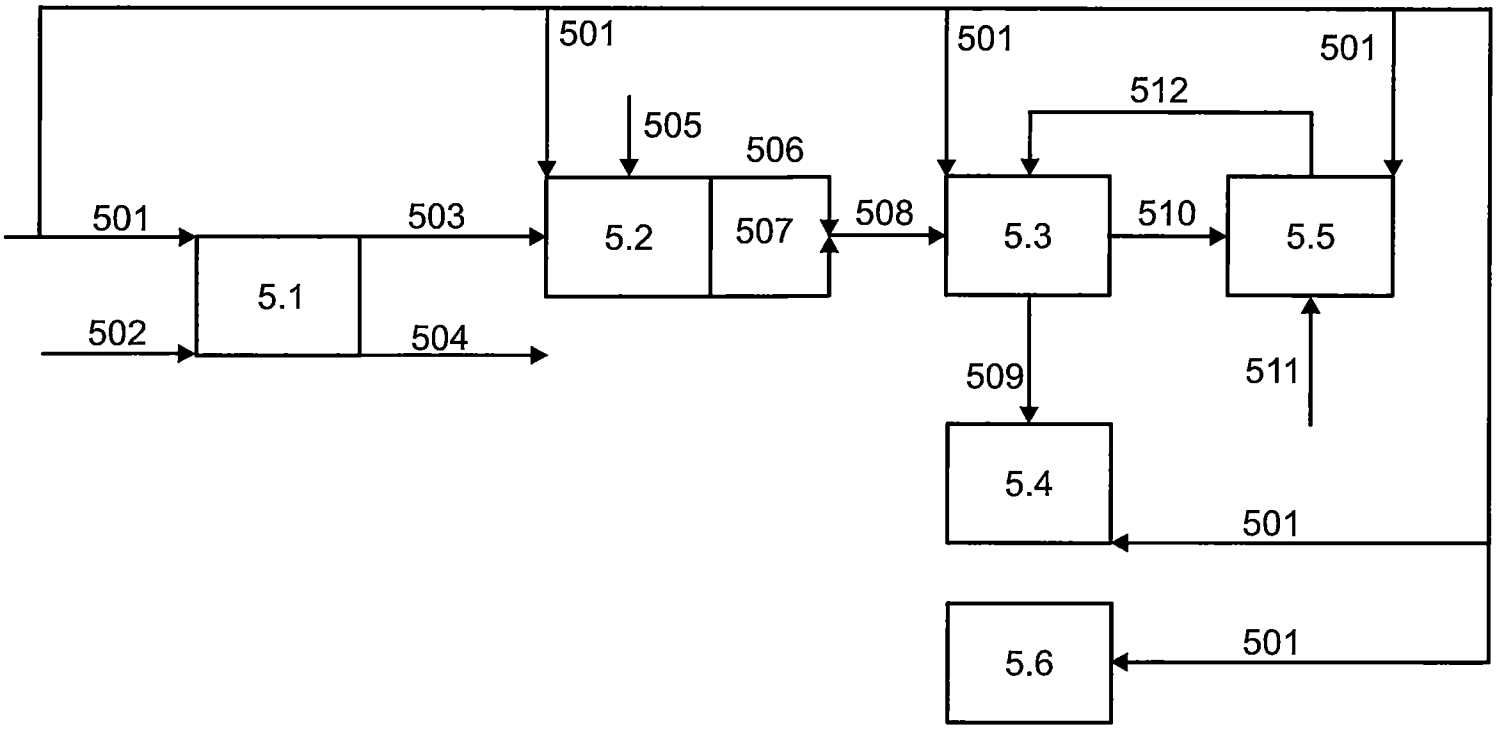
FIG. 5 shows an example of a process to produce carbon negative e-fuels. The listed elements are: 5.1—Electrolyzer; 5.2—RWGS Module; 5.3—LFP module; 5.4—Fractionation module; 5.5—Authothermal reforming module; 5.6—Utilities; 501—Power; 502—Water; 503—Hydrogen; 504—Oxygen; 505—$CO_2$; 506—CO; 507—Hydrogen; 508—Syngas; 509—Liquid hydrocarbons; 510—tail gas; 511—oxygen; 512—Additional feedstock for LFP.

One such process for producing fuels and chemicals is described herein and depicted schematically in FIG. 5. Overall, this process converts power, $CO_2$ and water into fuels and chemicals. Here, an electrolyzer 5.1 can use power 501 to convert water 502 into hydrogen 503 and oxygen 504. The hydrogen can be fed to a reverse water-gas-shift module 5.2 to be combined with $CO_2$ 505 to produce synthesis gas (syngas) 508 comprising carbon monoxide (CO) 506 and hydrogen 507. The syngas can be reacted in a liquid fuel production module 5.3 to produce liquid hydrocarbons 509, which can be separated into fuel and chemical products in a fractionation module 5.4. The productivity of the process can take the tail gas 510 from the liquid fuel production module to an autothermal reforming module 5.5 to be reacted with oxygen 511 produce additional feedstock 512 for the liquid fuel production module.

A large fraction of the overall power consumption of the process goes to the electrolyzer 5.1. Additional power from 501 can go to utilities 5.6 or modules other than the electrolyzer (e.g., reverse water-gas-shift, liquid fuel production, fractionation, autothermal reformer). However, these are typically much smaller than the amount of power that is dedicated to electrolysis.

The ratio of $H_2$ to $CO_2$ going into the RWGS reactor can be between 2.5 and 3.5. In some cases, the first ratio and/or the second ratio of $H_2$ to $CO_2$ are 2.5, 2.6, 2.7, 2.8, 2.9, 3.0, 3.1, 3.2, 3.3, 3.4, or 3.5. In some instances, the first ratio and/or second ratio of $H_2$ to $CO_2$ are between 2.5 and 4.0, between 2.6 and 4.0, between 2.7 and 4.0, between 2.8 and 4.0, between 2.9 and 4.0, between 3.0 and 4.0, between 3.1 and 4.0, between 3.2 and 4.0, between 3.3 and 4.0, between 3.4 and 4.0 or between 3.5 and 4.0. In some instances, the first ratio and/or second ratio of $H_2$ to $CO_2$ are between 2.0 and 2.5, between 2.0 and 2.6, between 2.0 and 2.7, between 2.0 and 2.8, between 2.0 and 2.9, between 2.0 and 3.0, between 2.0 and 3.1, between 2.0 and 3.2, between 2.0 and 3.3, between 2.0 and 3.4, or between 2.0 and 3.5.

$CO_2$ can be obtained from several sources. Industrial manufacturing plants that produce ammonia for fertilizer produce large amounts of $CO_2$. Ethanol plants that convert corn or wheat into ethanol produce large amounts of $CO_2$. Power plants that generate electricity from various resources (for example natural gas, coal, other resources) produce large amounts of $CO_2$. Chemical plants such as nylon production plants, ethylene production plants, other chemical plants produce large amounts of $CO_2$. Some natural gas processing plants produce $CO_2$ as part of the process of purifying the natural gas to meet pipeline specifications. Capturing $CO_2$ for utilization as described here often involves separating the $CO_2$ from a flue gas stream or another stream where the $CO_2$ is not the major component. Some $CO_2$ sources are already relatively pure and can be used with only minor treatment (which may include gas compression) in the processes described herein. Some processes may require an alkylamine sorbent (liquid or solid phase) or other method that would be used to remove the $CO_2$ from the flue gas steam. Alkylamines used in the process include monoethanolamine, diethanolamine, methydi-ethanolamine, disopropylamine, aminoethoxyethnol, or combinations thereof. Metal Organic Framework (MOF) materials and Zeolite derivatives have also been used as means of separating $CO_2$ from a dilute stream using chemisorption or physisorption to capture the $CO_2$ from the stream. Other methods to get concentrated $CO_2$ include chemical looping combustion where a circulating metal oxide material captures the $CO_2$ produced during the combustion process through carbonation or other mineralization pathways. $CO_2$ can also be captured from the atmosphere (through many of the same mechanisms) in what is called direct air capture (DAC) of $CO_2$.

Renewable sources of $H_2$ can be produced from water via electrolysis $$H_2O = H_2 + \frac{1}{2}O_2$$

This reaction uses electricity to split water into hydrogen and oxygen. Electrolyzers consist of an anode and a cathode separated by an electrolyte. Different electrolyzers function in slightly different ways, mainly due to the different type of electrolyte material involved.

However, each electrolysis technology has a theoretical minimum electrical energy input of 39.4 kWh/kg$H_2$ (HHV of hydrogen) if water is fed at ambient pressure and temperature to the system and all energy input is provided in the form of electricity. The required electrical energy input may be reduced below 39.4 kWh/kg$H_2$ if suitable heat energy is provided to the system. Besides electrolysis, significant current research is examining ways to split water into hydrogen and oxygen using light energy and a photocatalyst.

Different electrolyzer designs that use different electrolysis technology can be used including alkaline electrolysis, membrane electrolysis, polymer electrolyte membrane (PEM), solid oxide electrolysis (SOE), and high temperature electrolysis. Alkaline electrolysis is commercially capable of the larger >1 MW scale operation. Different electrolytes can be used including liquids KOH and NaOH with or without activating compounds can be used.

As described herein, the reverse water-gas-shift (RWGS) reaction can be used to produce syngas according to the formula:

$$CO_2+H_2=CO+H_2O$$

This reaction converts $CO_2$ and hydrogen to carbon monoxide and water. This reaction is endothermic at room temperature and requires heat to proceed and elevated temperature and a good catalyst is required for significant $CO_2$ conversion.

Hydrogen and $CO_2$ are mixed. The ratio of $H_2/CO_2$ can be between 2.0 mol/mol to 4.0 mol/mol, in some cases between 3.0 to 4.0 mol/mol. The mixed RWGS feedstock can be heated by indirect heat exchange to a temperature of greater than 900° F. This initial temperature rise can be done without the use of direct combustion of a carbon containing gas to provide the heat. This would mean that $CO_2$ was being produced and could possibly negate the impact of converting $CO_2$ to useful fuels and chemicals.

The RWGS feed gas, comprising a mixture of hydrogen and $CO_2$, can be heated to an inlet temperature. The inlet temperature can be any suitable temperature for performing the RWGS reaction such as 1550° F. to 1599° F., 1600° F. to 1649° F., 1650° F. to 1699° F., 1700° F. to 1749° F., 1750° F. to 1799° F., or 1800° F. to 1850° F.

The RWGS feed gas can be heated at least partially in a preheater outside the main reactor vessel to produce a heated feed gas. The preheater can be electrically heated and raises the temperature of the feed gas through indirect heat exchange.

There can be numerous ways that the electrical heating of the feed gas can be done. One way is through electrical heating in an electrically heated radiant furnace. In some embodiments, at least a portion of the feed gas passes through a heating coil in a furnace. In the furnace, the heating coil is surrounded by radiant electric heating elements, or the gas is passed directly over the heating elements whereby the gas is heated by some convective heat transfer. The electric heating elements can be made from numerous materials. The heating elements may be nickel chromium alloys. These elements may be in rolled strips or wires or cast as zig zag patterns. The elements are typically backed by an insulated steel shell, and ceramic fiber is generally used for insulation. The radiant elements may be divided into zones to give a controlled pattern of heating. Multiple coils and multiple zones may be needed to provide the heat to the feed gas and produce a heated feed gas. Radiant furnaces require proper design of the heating elements and fluid coils to ensure good view factors and good heat transfer. The electricity usage by the radiant furnace should be as low as possible. The electricity usage by the radiant furnace is less than 0.5 MWh (megawatt-hour) electricity/metric ton (MT) of $CO_2$ in the feed gas; in some cases, less than 0.40 MWh/MT $CO_2$; and in some cases, less than 0.20 MWh/MT $CO_2$.

The heated RWGS feed gas stream can then be fed into the main RWGS reactor vessel. There are at least two possible embodiments of the main RWGS reactor vessel. In some embodiments, the main RWGS reactor vessel is adiabatic or nearly adiabatic and is designed to minimize heat loss, but no added heat is added to the main reactor vessel and the temperature in the main reactor vessel will decline from the inlet to the outlet of the reactor. In some embodiments, the main RWGS reactor vessel is similarly designed but additional heat is added to the vessel to maintain an isothermal or nearly isothermal temperature profile in the vessel. The main RWGS reactor vessel can be a reactor with a length longer than diameter. The entrance to the main reactor vessel can be smaller than the overall diameter of the vessel. The main reactor vessel can be a steel vessel. The steel vessel can be insulated internally to limit heat loss. Various insulations including poured or castable refractory lining or insulating bricks may be used to limit the heat losses to the environment.

A bed of catalyst can be inside the main RWGS reactor vessel. The catalyst can be in the form of granules, pellets, spheres, tri-lobes, quadra-lobes, monoliths, or any other engineered shape to minimize pressure drop across the reactor. In some cases, the shape and particle size of the catalyst particles is managed such that pressure drop across the reactor is less than 100 pounds per square inch (psi) (345 kPa) and in some cases, less than 20 psi (139 kPa). The size of the catalyst form can have a characteristic dimension of between 1 mm and 10 mm. The catalyst particle can be a structured material that is porous material with an internal surface area greater than 10 $m^2/g$, in some cases greater than 40 $m^2/g$ with some cases having a surface area of 100 $m^2/g$ or greater.

The RWGS catalyst can be a high-performance solid solution catalyst that is highly versatile, and which efficiently performs the RWGS reaction.

In some cases, the pressure of the RWGS step and the pressure of the hydrocarbon synthesis or Liquid Fuel Production (LFP) step are within 200 psi of each other, in some cases within 100 psi of each other, and in some cases the pressures are equivalent. Operating the two processes at pressures close to each other limit the required compression of the syngas stream.

The per pass conversion of $CO_2$ to CO in the main RWGS reactor vessel can be between 60 and 90 mole % and in some cases between 70 and 85 mole %. If an adiabatic reactor is used, the temperature in the main RWGS reactor vessel can decline from the inlet to the outlet. The main RWGS reactor vessel outlet temperature can be 100° F. to 200° F. less than the main reactor vessel inlet temperature and in some cases between 105 and 160° F. lower than the main reactor inlet temperature. The RWGS Weight Hourly Space Velocity (WHSV) which is the mass flow rate of RWGS reactants ($H_2$+$CO_2$) per hour divided by the mass of the catalyst in the main RWGS reactor bed can be between 1,000 and 50,000 $hr^{-1}$ and in some cases between 5,000 and 30,000 $hr^{-1}$.

The gas leaving the main RWGS reactor vessel is the RWGS product gas stream. The RWGS product gas comprises CO, $H_2$, unreacted $CO_2$, and $H_2O$. Additionally, the RWGS product gas may also comprise small quantities of methane ($CH_4$) and/or elemental carbon (C) that were produced in the main reactor vessel by side reactions.

The RWGS product gas can be used in a variety of ways at this point in the process. The product gas can be cooled and compressed and used in downstream process to produce fuels and chemicals. The RWGS product gas can also be cooled, compressed, and sent back to the preheater and fed back to the main reactor vessel. The RWGS product gas can also be reheated in second electric preheater and sent to a second reactor vessel where additional conversion of $CO_2$ to CO can occur.

With the CO from the RWGS reaction and hydrogen from the electrolysis of water, the potential exists for useful products through the catalyst hydrogenation of carbon monoxide to hydrocarbons. Mixtures of $H_2$ and CO are called synthesis gas or syngas. Syngas may be used as a feedstock for producing a wide range of chemical products, including liquid fuels, alcohols, organic acids, ethers, aldehydes, ketones, ammonia, and many other chemical products.

The catalytic hydrogenation of carbon monoxide to produce light gases, liquids, and waxes, ranging from methane to heavy hydrocarbons ($C_{100}$ and higher), in addition to oxygenated hydrocarbons, is typically referred to Fischer-Tropsch (or F-T) synthesis. Traditional low temperature (<250° C.) F-T processes primarily produce a high weight (or wt. %) F-T wax ($C_{25}$ and higher) from the catalytic conversion process. These F-T waxes are then hydrocracked and/or further processed to produce diesel, naphtha, and other fractions. During this hydrocracking process, light hydrocarbons are also produced, which may require additional upgrading to produce viable products. The catalysts that are commonly used for F-T are either Cobalt (Co) based, or Iron (Fe) based catalysts are also active for the water gas shift (WGS) reaction that results in the conversion of feed carbon monoxide to $CO_2$.

In addition to F-T, the Liquid Fuel Production (LFP) module described herein can be used. The LFP reactor converts CO and $H_2$ into long chain hydrocarbons that can be used as liquid fuels and chemicals. This reactor can use a catalyst for production of liquid fuel range hydrocarbons from syngas. Syngas from syngas cooling and condensing can be blended with tail gas to produce an LFP reactor feed. The LFP reactor feed comprises hydrogen and carbon monoxide. Ideally the hydrogen to carbon monoxide ratio in the stream is between 1.9 and 2.2 mol/mol. The LFP reactor can be a multi-tubular fixed bed reactor system. Each LFP reactor tube can be between 13 mm and 26 mm in diameter. The length of the reactor tube is generally greater than 6 meters in length and in some cases greater than 10 meters in length. The LFP reactors are generally vertically oriented with LFP reactor feed entering at the top of the LFP reactor. However, horizontal reactor orientation is possible in some circumstances and setting the reactor at an angle may also be advantageous in some circumstances where there are height limitations.

Most of the length of the LFP reactor tube can be filled with LFP catalyst. The LFP catalyst may also be blended with diluent such as silica or alumina to aid in the distribution of the LFP reactor feed into and through the LFP reactor tube. The chemical reaction that takes place in the LFP reactor produces an LFP product gas that comprises most hydrocarbon products from five to twenty-four carbons in length ($C_5$-$C_{24}$ hydrocarbons) as well as water, although some hydrocarbons are outside this range. The LFP reactor does not typically produce any significant amount of $CO_2$. Between 0% and 2% of the carbon monoxide in the LFP reactor feed is typically converted to $CO_2$ in the LFP reactor. Only a limited amount of the carbon monoxide in the LFP reactor feed is typically converted to hydrocarbons with a carbon number greater than 24. Between 0% and 25% of the hydrocarbon fraction of the LFP product typically has a carbon number greater than 24. In some cases, between 1 wt. % and 10 wt. % of the hydrocarbon fraction of the LFP product has a carbon number greater than 24. In some cases, between 0 wt. % and 4 wt. % of the hydrocarbon fraction of the LFP product has a carbon number greater than 24. In some cases, between 0 wt. % and 1 wt. % of the hydrocarbon fraction of the LFP product has a carbon number greater than 24.

As discussed above, Fischer-Tropsch (F-T) processes generally make hydrocarbon products that are from 1 to 125 or greater carbon atoms' in length. The LFP catalyst described herein does not produce heavy hydrocarbons with the same yield as other catalysts used in the F-T process. In some embodiments, the LFP catalyst has insignificant activity for the conversion of conversion of CO to $CO_2$ via the water-gas-shift reaction. In some embodiments, the water gas shift conversion of carbon monoxide to $CO_2$ is between 0% and 5% of the carbon monoxide in the feed. In some embodiments, the LFP catalyst comprises cobalt as the active metal. In some embodiments, the LFP catalyst comprises iron as the active metal. In some embodiments, the LFP catalyst comprises combinations of iron and cobalt as the active metal. The LFP catalyst can be supported on a metal oxide support that chosen from a group of alumina, silica, titania, activated carbon, carbon nanotubes, zeolites or other support materials with sufficient size, shape, pore diameter, surface area, crush strength, effective pellet radius, or mixtures thereof. The catalyst can have various shapes of various lobed supports with either three, four, or five lobes with two or more of the lobes being longer than the other two shorter lobes, with both the longer lobes being symmetric. The distance from the mid-point of the support or the mid-point of each lobe is called the effective pellet radius which can contribute to achieving the desired selectivity to the $C_5$ to $C_{24}$ hydrocarbons. The LFP catalyst promoters may include one of the following: nickel, cerium, lanthanum, platinum, ruthenium, rhenium, gold, or rhodium. The LFP catalyst promoters are between 0.01 wt. % and 1 wt. % of the total catalyst and in some cases between 0.01 wt. % and 0.5 wt. % and in some cases between 0.01 wt. % and 0.1 wt. %.

The LFP catalyst support can have a pore diameter between 8 nanometers (nm) and 25 nanometers (nm), a mean effective pellet radius of between 25 microns and 600 microns, a crush strength between 3 lb./mm and 10 lb./mm, and a BET surface area between 100 $m^2/g$ and 200 $m^2/g$. The catalyst after metal impregnation can have a metal dispersion of 3.5% to 4.5%. Several types of supports have can maximize the $C_5$-$C_{24}$ hydrocarbon yield. These can include alumina/silica combinations, activated carbon, alumina, carbon nanotubes, and/or zeolite-based supports.

The LFP fixed bed reactor can be operated in a manner to maximize the $C_5$-$C_{24}$ hydrocarbon yield. The LFP reactor can be operated at pressures between 150 to 450 psi. The reactor can be operated over a temperature range from 350 to 460° F. and more typically between 405° F. to 415° F. The reaction is exothermic. The temperature of the reactor can be maintained inside the LFP reactor tube's by the reactor tube bundle being placed into a heat exchanger where boiling steam is present on the outside of the LFP reactor tubes. The steam temperature is at a lower temperature than the LFP reaction temperature so that heat flows from the LFP reactor tube to the lower temperature steam. The steam temperature can be maintained by maintaining the pressure of the steam. The steam is generally saturated steam. In some embodiments, the catalytic reactor can be a slurry reactor, microchannel reactor, fluidized bed reactor, or other reactor types known in the art.

The CO conversion in the LFP reactor can be maintained at between 30 to 80 mole % CO conversion per pass. CO can be recycled for extra conversion or sent to a downstream additional LFP reactor. The carbon selectivity to $CO_2$ can be minimized to between 0% and 4% of the converted CO and in some cases between 0% and 1%. The carbon selectivity for $C_5$-$C_{24}$ hydrocarbons can be between 60 and 90%. The LFP reactor product gas contains the desired $C_5$-$C_{24}$ hydrocarbons, which are condensed as liquid fuels and water, as well as unreacted carbon monoxide, hydrogen, a small amount of $C_1$-$C_4$ hydrocarbons, and a small amount of $C_{24+}$ hydrocarbons. The desired product can be separated from the stream by cooling, condensing the product and/or distillation or any other acceptable means. The unreacted carbon monoxide, hydrogen, and $C_1$-$C_4$ hydrocarbons can be part of the feed to the auto-thermal reformer (ATR).

In one embodiment, the liquid fuel production module produces a diesel fuel product. The diesel fuel product has much improved WTW-GGC content and improved physical properties. Table 1 shows a comparison of some key performance parameters of fuel between diesel produced in the CNER versus petroleum diesel. As can be seen, the CNER diesel is superior in a number of performance criteria.

TABLE 1

Comparison of Petroleum Diesel to CNER Diesel Fuel Properties

| Fuel Property | Reference # | Petroleum Diesel Properties | CNER Diesel Fuel |
|---|---|---|---|
| Carbon Intensity $gCO_2e/MJ$ (WTW-GGC) | GREET 13868 | 90-100 | <0 |
| Ash % mass, max | ASTM D482 | 0.01 | <0.01 |
| Sulfur, ppm (ug/g) max | ASTM D5453 | 15 | <1.0 |
| Copper strip corrosion rating, max | ASTM D130 | No. 3 | 1a |
| Cetane number, min | ASTM D613 | 40 | >65 |
| Cetane index, min | ASTM D976-80 | 40 | >65 |
| Aromaticity, % vol, max | ASTM D1319 | 35 | <1 |
| Ramsbottom carbon residue on 10% distillation residue, % mass, max | ASTM D524 | 0.35 | 0.06 |
| Total contamination (mg/kg), max | EN 12662 | 24 | <12 |
| poly aromatic hydrocarbons % (m/m), max | EN 12916/IP 391/95 | 11 | <1 |

In one embodiment, the LFP product is further hydroprocessed and hydro-isomerized to produce a sustainable aviation fuel (SAF) that meets ASTM D7566. The properties of the fuel are improved versus petroleum-based jet fuel is shown in Table 2. As can be seen, the CNER jet fuel is superior in a number of performance criteria.

TABLE 2

Comparison of Petroleum Jet Fuel Properties to CNER Jet Fuel

| Fuel Property | Reference # | Petroleum Jet Fuel Properties | CNER SAF Jet Fuel |
|---|---|---|---|
| Carbon Intensity $gCO_2e/MJ$ (WTW-GGC) | GREET 13868 | 90-100 | <0 |
| Acidity, mg KOH/g | ASTM D3242 | 0.1 | <0.02 |
| Sulfur, ppm (ug/g) max | ASTM D5453 | 15-30 | <1.0 |
| Existent Gum, mg/100 ml | ASTM D381 | 7 | <1 |
| aromaticity, % vol, max | ASTM D1319 | 35 | <1 |
| Copper strip corrosion rating, max | ASTM D130 | No. 3 | 1a |
| Naphthalene vol % | ASTM D1840 | 3 | <0.01 |

In the auto-thermal reformer (ATR), the ATR hydrocarbon feed comprises CO, $H_2$, and $C_1$-$C_4$ hydrocarbons. The auto-thermal reforming of natural gas that is predominately $CH_4$ to CO and $H_2$.

In some embodiments, the ATR hydrocarbon feed comprises the unreacted CO, $H_2$, and $C_1$-$C_4$ hydrocarbons. In some cases, the feed also comprises natural gas. The natural gas comprises methane and may contain light hydrocarbons as well as $CO_2$. In some embodiments, the fuel and chemicals produced may not be zero carbon fuels but will still have an improved carbon intensity over traditional fuels and chemicals. The ATR feed can be converted to syngas (including a large percentage of hydrogen). This can reduce the amount of water that needs to be electrolyzed to produce hydrogen and reduces the size of the electrolyzer. This may be more economical when producing low carbon fuels and chemicals. In the ATR hydrocarbon feed, the ratio of natural gas to LFP unreacted carbon monoxide, hydrogen, and $C_1$-$C_4$ hydrocarbons can be less than 2.0 kg/kg. In some cases, less than 1.25 kg/kg.

The ATR can produce a product that is high in carbon monoxide. The $CO_2$ in the product gas can be between 0 mol % and 10 mol %. The ATR oxidant feed can comprise steam and oxygen where the oxygen is produced by the electrolysis of water. The ATR oxidant feed and the ATR hydrocarbon feed can be preheated and then reacted in an ATR burner where the oxidant and the hydrocarbon are partially oxidized at temperatures in the burner of between 2000° C. and 3000° C. The ATR reactor can be divided into a plurality of zones. The combustion zone (or burner) is where at least portion of the ATR hydrocarbon feedstock is fully combusted to water and $CO_2$. The thermal zone is where thermal reactions occur. In the thermal zone, further conversion occurs by homogeneous gas-phase-reactions. These reactions can be slower reactions than the combustion reactions like CO oxidation and pyrolysis reactions involving higher hydrocarbons. The main overall reactions in the thermal zone can include the homogeneous gas-phase steam hydrocarbon reforming and the shift reaction. In the catalytic zone, the final conversion of hydrocarbons takes place through heterogeneous catalytic reactions including steam methane reforming and water gas shift reaction. The resulting ATR product gas can have a composition that is close to the predicted thermodynamic equilibrium composition. The actual ATR product gas composition can be the same as the thermodynamic equilibrium composition within a difference of between 5° C. and 70° C. This is the so-called equilibrium approach temperature. To keep the amount of $CO_2$ produced in the ATR to a minimum, the amount of steam in the ATR oxidant feed is kept low. This results in a low soot ATR product gas that is close to the equilibrium predicted composition. Typically, the total steam to carbon ratio (mol/mol) in the combined ATR feed (oxidant+hydrocarbon) can be between 0.4 to 1.0, with the optimum being between 0.55 and 0.65.

The ATR product can leave the ATR catalytic zone at temperatures more than 800° C. The ATR product can be cooled to lower temperatures through a waste heat boiler where the heat is transferred to generate steam. This steam, as well as the lower pressure steam produced by the LFP reactor, can be used to generate electricity.

Suitable ATR catalysts for the catalytic zone reactions are typically nickel based. The novel solid solution catalyst described herein can be used as an ATR catalyst. Other suitable ATR catalysts are nickel on alpha phase alumina or magnesium alumina spinel ($MgAl_2O_4$) with or without precious metal promoters. The precious metal promoter can comprise gold, platinum, rhenium, or ruthenium. Spinels can have a higher melting point and a higher thermal strength and stability than the alumina-based catalysts.

The ATR product can be blended with the RWGS product and be used as LFP reactor feed. This can result in a high utilization of the original $CO_2$ to $C_5$ to $C_{24}$ hydrocarbon products.

In some embodiments, the LFP product gas is not suitable as a direct feed to the ATR and must be pre-reformed. In those cases, the LFP product gas comprising the unreacted carbon monoxide, hydrogen, $C_1$-$C_4$ hydrocarbons and $CO_2$ comprise the pre-reformer hydrocarbon feed gas. The higher hydrocarbons and carbon oxides in the stream may require the use of a pre-reformer instead of directly being used in as ATR hydrocarbon feed. The pre-reformer is generally an adiabatic reactor. The adiabatic pre-reformer converts higher hydrocarbons in the pre-reformer feed into a mixture of methane, steam, carbon oxides and hydrogen that are then suitable as ATR hydrocarbon feed. One benefit of using a pre-reformer is that it enables higher ATR hydrocarbon feed pre-heating that can reduce the oxygen used in the ATR. The resulting integrated process as described above results in high conversion of $CO_2$ to $C_5$-$C_{24}$ hydrocarbon products that are suitable as fuels or chemicals.

In some embodiments, an autothermal reforming (ATR) process that converts the tail gas (and potentially other hydrocarbon feedstocks) from the fuel/chemical production stage and oxygen from the electrolysis processes into additional syngas. In some embodiments, the use of heat energy from the ATR process for operation of the ($CO_2$) RWGS (hydrogenation) catalyst. In some embodiments, the separation and conversion of the $CO_2$ from the ATR process into additional syngas using the $CO_2$ hydrogenation catalyst. In some embodiments, a RWGS catalyst, reactor, and process converts $CO_2$ and hydrogen into syngas and operating this RWGS operation at a pressure that is close to the pressure of the fuel/chemical production process, which converts the syngas into fuels or chemicals. In some cases, these fuels or chemicals are paraffinic or olefinic hydrocarbon liquids with a majority being in the $C_5$-$C_{24}$ range.

The systems and methods described herein can utilize a sensor. The sensor can be a flowrate sensor, a sensor that detects the chemical composition of a process stream, a temperature sensor, a pressure sensor, or a sensor coupled to the price or availability of a process input, such as $CO_2$ or electrical power.

In an aspect, the systems and methods described herein efficiently capture and utilize $CO_2$ and convert it into useful products such as fuels (e.g., diesel fuel, gasoline, gasoline blendstocks, jet fuel, kerosene, other) and chemicals (e.g., solvents, olefins, alcohols, aromatics, lubes, waxes, ammonia, methanol, other) that can displace fuels and chemicals produced from fossil sources such as petroleum and natural gas. This can lower the total net emissions of $CO_2$ into the atmosphere. Zero carbon, low carbon, or ultra-low carbon fuels and chemicals have minimal fossil fuels combusted in the process. In some cases, any heating of the feeds to the integrated process is done by indirect means (e.g., cross exchangers) or via electric heating where the electricity comes from a zero carbon or renewable source such as wind, solar, geothermal, or nuclear.

The following are certain embodiment of processes for the conversion of $CO_2$, water, and renewable electricity into negative carbon high quality fuels and chemicals:

Example 1

Figure 6:
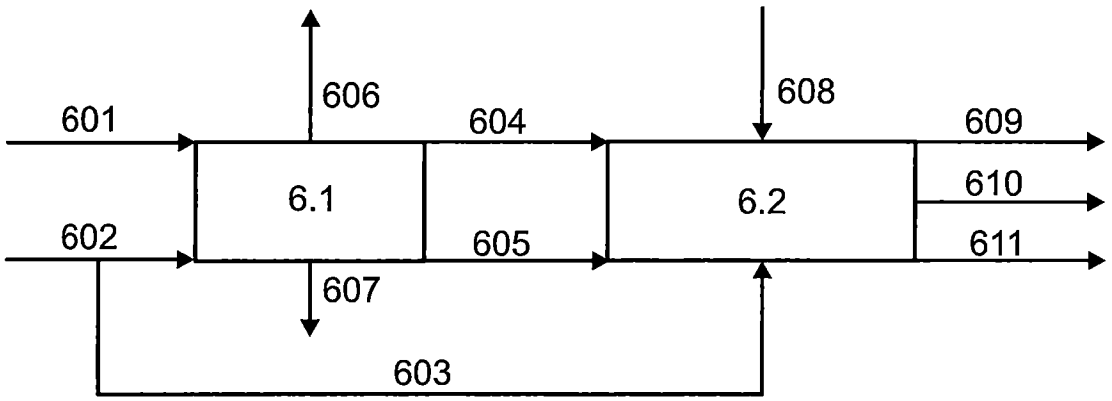
FIG. 6 shows an example of a process to produce e-fuels. The listed elements are: 6.1—Electrolysis; 6.2—Infinium Process (RWGS/LFP); 601—Water; 602—Power; 603—Power; 604—H2; 605—O2; 606—O2; 607—Waster water; 608—CO2; 609—Efuels; 610—Waste Water; 611—Purge.

In this previously performed example, water was fed into an electrolysis system powered using renewable electricity to produce hydrogen and oxygen. $CO_2$ was captured from a source. The $CO_2$ was mixed with the hydrogen from the electrolysis system to form a stream (Reverse Water Gas Shift feedstock or "RWGS" feedstock) that was heated and fed into a RWGS reactor vessel that includes a RWGS catalyst. The RWGS reactor converted the feedstock to an RWGS product gas comprising CO, $H_2$, unreacted $CO_2$ and $H_2O$. FIG. 6 shows a typical e-fuels facility. Water (1) and power (2) were used in an electrolysis.

A summary of the major process streams is shown in the Table 3. The stream numbers are as shown in FIG. 6. This is an example of a Carbon Neutral e-fuel facility that results in a carbon NEUTRAL e-fuel as previously shown in FIG. 3 as Unit. 3.1.

TABLE 3

Example of the Mass and Energy Balance for the E-Fuel Production Facility (Base Case) E-fuel production capacity: 1000 bbl./day

| | | | |
|---|---|---|---|
| 1 | Water | 13496.99 | kg/hr |
| 2 | Power | 178.50 | MW |
| 3 | Power | 13.10 | MW |
| | Heaters | 6.73 | MW |
| | Compressors | 3.64 | MW |
| | Pumps, Fin-Fans, BOP | 2.73 | MW |
| | Turbine | −4.60 | MW |
| 4 | $H_2$ | 2881.55 | kg/hr |
| 5 | $O_2$ | 6344.89 | kg/hr |
| 6 | $O_2$ | 17404.59 | kg/hr |
| 8 | $CO_2$ | 16250.00 | kg/hr |
| 9 | E-fuels | 11080.56 | kg/hr |
| | | 32222.65 | kJ/liter |
| | | 112.89 | lpm |
| 7, 10 | Waste-Water | 5748.74 | kg/hr |
| 11 | Purge | 889.61 | kg/hr |

The base case, corresponding to a carbon neutral e-fuel facility, as shown in FIG. 3 has the carbon inputs and outputs as shown in Table 4.

TABLE 4

| Inputs and Outputs for Base Case with Carbon Intensity | | |
|---|---|---|
| Input | | |
| $CO_2$ | 16250.00 | kg/hr |
| $H_2$ | 2881.55 | kg/hr |
| Power | 8.50 | MW |
| Output | | |
| e-Fuels | 11080.56 | kg/hr |
| Purge | 889.61 | kg/hr |
| Carbon Intensity | 0.0 | g $CO_2$e/MJ |

This process case has a carbon intensity of 0 $gCO_2e/MJ$. The assumptions are based on a lifecycle analysis of the process, not including transportation of fuels to the delivery markets. Typically, the latter adds 0.5 to 5 $gCO_2e/MJ$, depending on the mode of transportation used. Other assumptions include: all anthropogenic $CO_2$ and therefore has a negative carbon intensity (avoided emissions); all hydrogen produced from renewable sources and therefore has no associated carbon intensity; all the carbon that entered the process and was not purged or captured in canisters via wastewater treatment exits as fuel which is then combusted. The $CO_2$ was emitted to the atmosphere but because the source was considered anthropogenic and an avoided emission on entry it is counted as a net balance; all material sent to the purge was oxidized and exits at $CO_2$; and does not account for transportation of the fuels to delivery markets.

Example 2

The above process (Example 1) was performed using renewable natural gas, which has a negative carbon intensity associated with it. In this previously performed example, the carbon intensity of the fuels produced by the process was −3.33 $gCO_2e/MJ$. This was an example of a Carbon Negative E-Fuel Refinery (CNER).

TABLE 5

| Example 2 Carbon Intensity Calculation and Renewable Natural Gas (RNG) Requirement | | |
|---|---|---|
| Input | | |
| $CO_2$ | 16250.00 | kg/hr |
| $H_2$ | 2881.55 | kg/hr |
| RNG | | |
| Power | 1.77 | MW |
| Output | | |
| eFuels | 218263.60 | MJ/hr |
| Purge | 889.61 | kg/hr |
| Carbon Intensity | −3.33 | $gCO_2e/MJ$ |
| RNG Volume Requirement Calculation | | |
| Heating Duty | 22.50 | MMBTU/hr |
| Burner Efficiency | 75% | |
| RNG Required | 30.00 | MMBTU/hr |
| | 31,654.92 | MJ/hr |
| RNG CI | −22.93 | $gCO_2e/MJ$ |

Assumptions include all of the electric heating is replaced with a fired heater fed by RNG; all the carbon that entered the process and is not purged or captured in canisters via wastewater treatment exits as fuel which is than combusted. The $CO_2$ was emitted to the atmosphere but because the source was considered anthropogenic and an avoided emission on entry it is counted as a net balance; CARB Reference: Pathway T2N-1019.

Example 3

The above process (Example 1) was performed where excess $O_2$ is used to displace $O_2$ used in another process. Oxygen is one of the most important technical gases. It finds many applications in glass production, steel manufacturing, mining, waste-water treatment facilities, as well as medical applications. Typically, industrial oxygen is produced using an air separation unit (ASU), pressure swing adsorption (PSA), or vacuum pressure swing adsorption (VPSA). These methods rely on cryogenics, membranes, or adsorption. Typical energy consumption in cryogenic $O_2$ units exceeds 200 kWh of electricity per ton of produced $O_2$. With stream 6 replacing carbon intensive conventional $O_2$ production, the carbon intensity of the e-fuel produced by the process is −4.57 $gCO_2e/MJ$. This is an example of a Carbon Negative E-Fuel Refinery (CNER).

TABLE 6

| Carbon Intensity Calculations for Example 3 | | |
|---|---|---|
| Input | | |
| $CO_2$ | 16,250.00 | kg/hr |
| $H_2$ | 2,881.55 | kg/hr |
| Power | 1.77 | MW |
| Output | | |
| e-Fuels | 218,263.60 | MJ/hr |
| Purge | 889.61 | kg/hr |
| $O_2$ | 17,404.59 | kg/hr |
| Carbon Intensity | −4.57 | gCO2e/MJ |
| $0_2$ Carbon Intensity Calculation | | |
| CRYO energy consumption | 140.00 | kWh/ton |
| Carbon Intensity | 371.31 | $gCO_2/kWh$ |
| $O_2$ Intensity | 57.30 | $gCO_2/kg$ |
| Infinium $O_2$ CI | 0.0 | $gCO_2/kg$ |

Assumptions include: all the carbon that entered the process and is not purged or captured in canisters via wastewater treatment exits as fuel which is than combusted. The $CO_2$ is emitted to the atmosphere but because the source was considered anthropogenic and an avoided emission on entry it is counted as a net balance; clean Oxygen that isn't consumed by the hydrocarbons process can be exported is sold into market displacing fossil-based oxygen.

Example 4

The above process (Example 1) was performed where naphtha co-product is sequestered in a product that is not combusted to produce $CO_2$. Now, the carbon intensity of the process is −19.43 $gCO_2e/MJ$. This is an example of a Carbon Negative E-Fuel Refinery (CNER).

TABLE 7

| Carbon Intensity Calculation for Example 4 | | |
|---|---|---|
| Input | | |
| $CO_2$ | 16250.00 | kg/hr |
| $H_2$ | 2881.55 | kg/hr |
| Power | 1.77 | MW |

TABLE 7-continued

| Carbon Intensity Calculation for Example 4 | | |
|---|---|---|
| Output | | |
| e-Fuels | 218263.60 | MJ/hr |
| Purge | 889.61 | kg/hr |
| $O_2$ | 17404.59 | kg/hr |
| Carbon Intensity | −19.43 | $gCO_2e/MJ$ |

Assumptions include: all the carbon that entered the process and is not purged or captured in canisters via wastewater treatment, exits as fuel which is than combusted. The $CO_2$ is emitted to the atmosphere but because the source was considered anthropogenic and an avoided emission on entry it is counted as a net balance; Carbon content in naphtha product stream in 2500 bbl./day facility per model 207.08; mass of input $CO_2$ going towards Naphtha based on carbon content; the percent of input $CO_2$ which eventually is found in the Naphtha based on tracking carbon.

Example 5

In this example, the base case (Example 1) was modified such that

1. RNG is used as fuel gas to the heaters, but the $CO_2$ produced by the combustion is captured and sent to $CO_2$ sequestration.
2. 10% of the $CO_2$ feed to the facility is sent to $CO_2$ sequestration.
3. 10% of the Hydrogen produced by the electrolyzer is sold as a product and displaces hydrogen produced by Steam Methane Reforming. This offsets 9.33 kg $CO_2$/kg $H_2$ (Sun et al, 2019)
4. Oxygen is sold and displaces $O_2$ produced from fossil energy.
5. Naphtha is sold as a non-combustible.

The WWGC of the e-fuel in this example is −68.10 $gCO_2/MJ$.

TABLE 8

| Carbon Intensity Calculation for Example 5 CNER | | |
|---|---|---|
| Input | | |
| $CO_2$ | 16250.00 | kg/hr |
| $H_2$ | 2881.55 | kg/hr |
| RNG | | |
| Power | 1.77 | MW |
| Output | | |
| eFuels | 157149.79 | MJ/hr |
| $H_2$ | 288.155208 | kg/hr |
| $CO_2$ | 1,741.02 | kg/hr |
| $CO_2$ | 1625.00016 | kg/hr |
| Naphtha | 2925.00029 | kg $CO_2$/hr |
| Oxygen | 17404.59 | kg/hr |
| Purge | 889.61 | kg/hr |
| Carbon Intensity | −68.10 | $gCO_2e/MJ$ |

The above-described embodiments can be implemented in any of numerous ways. For example, the embodiments may be implemented using hardware, software, or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware or with one or more processors programmed using microcode or software to perform the functions recited above.

In this respect, it should be appreciated that one implementation of the embodiments of the present invention comprises at least one non-transitory computer-readable storage medium (e.g., a computer memory, a portable memory, a compact disk, etc.) encoded with a computer program (i.e., a plurality of instructions), which, when executed on a processor, performs the above-discussed functions of the embodiments of the present invention. The computer-readable storage medium can be transportable such that the program stored thereon can be loaded onto any computer resource to implement the aspects of the present invention discussed herein. In addition, it should be appreciated that the reference to a computer program which, when executed, performs the above-discussed functions, is not limited to an application program running on a host computer. Rather, the term computer program is used herein in a generic sense to reference any type of computer code (e.g., software or microcode) that can be employed to program a processor to implement the above-discussed aspects of the present invention.

Various aspects of the present invention may be used alone, in combination, or in a variety of arrangements not specifically discussed in the embodiments described in the foregoing and are therefore not limited in their application to the details and arrangement of components set forth in the foregoing description or illustrated in the drawings. For example, aspects described in one embodiment may be combined in any manner with aspects described in other embodiments.

Also, embodiments of the invention may be implemented as one or more methods, of which an example has been provided. The acts performed as part of the method(s) may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of subject matter within this disclosure are contemplated as being part of the inventive subject matter disclosed herein.

Still other aspects, examples, and advantages of these exemplary aspects and examples, are discussed in detail below. Moreover, it is to be understood that both the foregoing information and the following detailed description are merely illustrative examples of various aspects and are intended to provide an overview or framework for understanding the nature and character of the claimed aspects and examples. Any example disclosed herein may be combined with any other example in any manner consistent with at least one of the objects, aims, and needs disclosed herein, and references to "an example," "some examples," "an alternate example," "various examples," "one example," "at least one example," "this and other examples" or the like are not necessarily mutually exclusive and are intended to indicate that a particular feature, structure, or characteristic described in connection with the example may be included in at least one example. The appearances of such terms herein are not necessarily all referring to the same example.

REFERENCES

Argonne National Laboratory: GREET Model, ANL, Argonne, IL (2021). www.greet.es.anl.gov Budina, S.: Going carbon negative: what are the technology options, International Energy Administration (January 2020).

California Air Resources Board, LCFS pathway certified carbon intensities (2022). www.ww2.arb.ca.gov/resources/documents/lcfs-pathway-certified-carbon-intensities.

IPCC: Synthesis reports I, II and III on climate change 2022, Intergovernmental Panel on Climate Change, Sixth Assessment Report (AR6) (Apr. 5, 2022).

National Academies of Sciences, Engineering, and Medicine: Gaseous carbon waste streams utilization: status and research needs, Chapter 4: Chemical utilization of $CO_2$ into chemicals and fuels, The National Academies Press pp. 63-97 (2019). https://doi.org/10.17226/25232.

Ransom, C., Rvalitera, N.: State of the global climate 2021, World Meteorological Organization (2021). www.public.wmo.int/en/our-mandate/climate/wmo-statement-state-of-global-climate Schuetzle, D.: Historical and predicted global climate changes and some potential accelerated climate moderation approaches, Global Climate Action Summit, San Francisco, CA (Sep. 10-14, 2018) and the Under2 Coalition, ResearchGate, 1-42 (2020). www.researchgate.net U.S. Energy Information Administration (EIA): U.S. energy related CO2 emissions (Dec. 22, 2021). www.eia.gov./environment/emissions/carbon

What is claimed is:

1. A method of producing fuel, wherein the fuel has a well-to-wheels greenhouse gas content of less than zero, and wherein the method comprises:

a. obtaining a feedstock comprising $CO_2$;

b. electrolyzing water using renewable power to produce $H_2$ and $O_2$;

c. reacting the $H_2$ and the feedstock comprising $CO_2$ with a catalyst to produce synthesis gas;

d. reacting the synthesis gas with one or more catalysts to produce a fuel-related product, wherein the fuel-related product comprises $C_5$-$C_{24}$ hydrocarbons and a non-combustible product, and wherein the non-combustible product is napththa;

e. collecting the $C_5$-$C_{24}$ hydrocarbons, wherein the hydrocarbons have a sulfur content between 0 ppm and 1.0 ppm and an aromaticity value between 0 and 1.0 vol %, and wherein the hydrocarbons have a well-to-wheels greenhouse gas content of less than zero;

f. sequestering the napththa in a product that is not combusted to produce $CO_2$ thereby producing a fuel having a well-to-wheels gas content of less than zero and providing a negative carbon intensity for the method.

2. The method of claim 1, wherein the fuel is diesel fuel.

3. The method of claim 2, wherein a feedstock comprising carbon-containing gases is reacted with the catalyst along with $H_2$ and the feedstock comprising $CO_2$ to produce synthesis gas.

4. The method of claim 3, wherein the carbon-containing gases comprise renewable natural gas, flared gas or landfill gas.

5. The method of claim 2, wherein a portion of the $CO_2$ in the feedstock comprising $CO_2$ is sequestered.

6. The method of claim 1, wherein the fuel is jet fuel.

7. The method of claim 6, wherein a feedstock comprising carbon-containing gases is reacted with the catalyst along with $H_2$ and the feedstock comprising $CO_2$ to produce synthesis gas.

8. The method of claim 7, wherein the carbon-containing gases comprise renewable natural gas, flared gas, or landfill gas.

9. The method of claim 6, wherein a portion of the $CO_2$ in the feedstock comprising $CO_2$ is sequestered.

* * * * *